US010525610B2

(12) United States Patent
Dries et al.

(10) Patent No.: US 10,525,610 B2
(45) Date of Patent: Jan. 7, 2020

(54) ADJUSTABLE PUNCH BODY ASSEMBLY

(71) Applicant: Amada Tool America, Inc., Batavia, NY (US)

(72) Inventors: Edward A. Dries, Le Roy, NY (US); Jeffrey Tauscher, Basom, NY (US)

(73) Assignee: Amanda Tool America, Inc., Batavia, NY (US)

( * ) Notice: Subject to any disclaimer, the term of this patent is extended or adjusted under 35 U.S.C. 154(b) by 178 days.

(21) Appl. No.: 15/479,018

(22) Filed: Apr. 4, 2017

(65) Prior Publication Data

US 2018/0281222 A1 Oct. 4, 2018

(51) Int. Cl.
*B26F 1/14* (2006.01)
*B21D 28/34* (2006.01)

(52) U.S. Cl.
CPC ..... *B26F 1/14* (2013.01); *B21D 28/346* (2013.01)

(58) Field of Classification Search
CPC ..... B26F 1/14; B21D 28/346
See application file for complete search history.

(56) References Cited

U.S. PATENT DOCUMENTS 5,020,407 A * 6/1991 Brinlee ..... B21D 28/12 83/530
5,839,341 A * 11/1998 Johnson ..... B21D 28/34 83/530
6,047,621 A 4/2000 Dries et al.
6,142,052 A 11/2000 Endo
6,276,247 B1 8/2001 Helda
7,156,009 B2 1/2007 Iwamoto et al.
7,168,356 B2 1/2007 Rosene et al.
7,658,134 B2 2/2010 Morgan
7,926,399 B2 * 4/2011 Huang ..... B21D 28/005 29/33 J
7,954,404 B2 6/2011 Thielges et al.
8,408,111 B2 4/2013 Johnston et al.
8,616,107 B2 * 12/2013 Kraft ..... B21D 28/34 83/686
8,714,065 B2 5/2014 Takahashi et al.
8,997,617 B2 * 4/2015 Thomson ..... B21D 28/246 234/94

(Continued)

FOREIGN PATENT DOCUMENTS

JP 2002282963 A 10/2002
JP 2010179371 A 8/2010
WO WO 2014/189878 A2 11/2014

*Primary Examiner* — Omar Flores Sanchez
(74) *Attorney, Agent, or Firm* — Blank Rome LLP

(57) ABSTRACT

An adjustable punch body assembly and method of adjusting a punch body assembly that includes a punch body that has a driver engagement end and an opposite cutting end, and a longitudinal inner bore the extends between the driver engagement and cutting ends. The driver engagement end includes a first adjustable engagement. A driver is configured to adjustably couple to the punch body. The driver includes a base that has a second adjustable engagement corresponding to the first adjustable engagement of the punch body to establish an axial position of the driver with respect to the punch body on a longitudinal axis thereof. A stem extends from the base for mating with a punch head. A locking mechanism is provided at the driver engagement end of the punch body for locking the axial position of the driver.

14 Claims, 4 Drawing Sheets

(56) References Cited

U.S. PATENT DOCUMENTS

| | | | | |
|---|---|---|---|---|
| 2010/0206150 | A1* | 8/2010 | Kraft | B21D 28/34<br>83/140 |
| 2014/0345435 | A1* | 11/2014 | Johnston | B21D 28/346<br>83/698.91 |

* cited by examiner

ADJUSTABLE PUNCH BODY ASSEMBLY

FIELD OF THE INVENTION

The present invention relates to a punch body assembly for a punching tool. More specifically, the present invention relates to a punch body assembly that is adjustable, thereby allowing adjustment of the length of the punching tool.

BACKGROUND OF THE INVENTION

Punching tools are typically used for creating different sizes and shapes of indentations or cuts in a workpiece, such as sheet metal. Punching tools often wear down from use, however, and thus either re-machining, re-surfacing, or replacement of the tool is required.

A need exists for a punch body assembly for a punching tool that allows easy in-field adjustment of the length of the driver of the punching tool, thereby avoiding re-machining or replacement of the tool when it wears down.

SUMMARY OF THE INVENTION

Accordingly, the present invention may provide an adjustable punch body assembly and method of adjusting a punch body assembly that includes a punch body that has a driver engagement end and an opposite cutting end, and a longitudinal inner bore the extends between the driver engagement and cutting ends. The driver engagement end includes a first adjustable engagement. A driver is configured to adjustably couple to the punch body. The driver includes a base that has a second adjustable engagement corresponding to the first adjustable engagement of the punch body to establish an axial position of the driver with respect to the punch body on a longitudinal axis thereof. A stem extends from the base for mating with a punch head. A locking mechanism is provided at the driver engagement end of the punch body for locking the axial position of the driver. The driver is rotatably coupled to the driver engagement end of the punch body. The first adjustable engagement may comprise external threads on the driver engagement end of the punch body and the second adjustable engagement may comprise internal threads in the base of the driver that engage the external threads. An ejector member may be retained by the punch body. The ejector member may have a body that is spring biased at one end and an ejector extension at the other end. A spring may be disposed between the one end of the ejector member and the base of the driver. The locking mechanism may include a plurality of position bores disposed in the driver engagement end of the punch body. The plurality of position bores may be arranged annularly around an end face of the driver engagement end of the punch body. The base of the driver may include at least one locking hole that axially aligns with one of the plurality of position holes. At least one fastener may be received in the locking hole of the base and in the one of the plurality of position holes of the punch body for locking the driver in the axial position. The cutting end of the punch body may include at least one external slot for aligning the punch body with a punching machine.

The present invention may also provide an adjustable punch body assembly, that comprises a punch body including a driver engagement end and an opposite cutting end, and a longitudinal inner bore extending between the driver engagement and cutting ends. A driver is configured to adjustably couple to the punch body. The driver includes a base and a stem extending from the base for mating with a punch head. Means are provided for adjusting an axial position of the driver with respect to the punch body on its longitudinal axis and means are provided for locking the axial position of the driver.

The present invention may yet further provide a method of adjusting a punch body assembly that has a punch body coupled to a driver, that comprises the steps of coupling a base of the driver to a driver engagement end of the punch body; rotating the driver with respect to the punch body until a select axial position of the driver with respect to the punch body is reached along a longitudinal axis of the punch body; and locking the select axial position of the driver.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
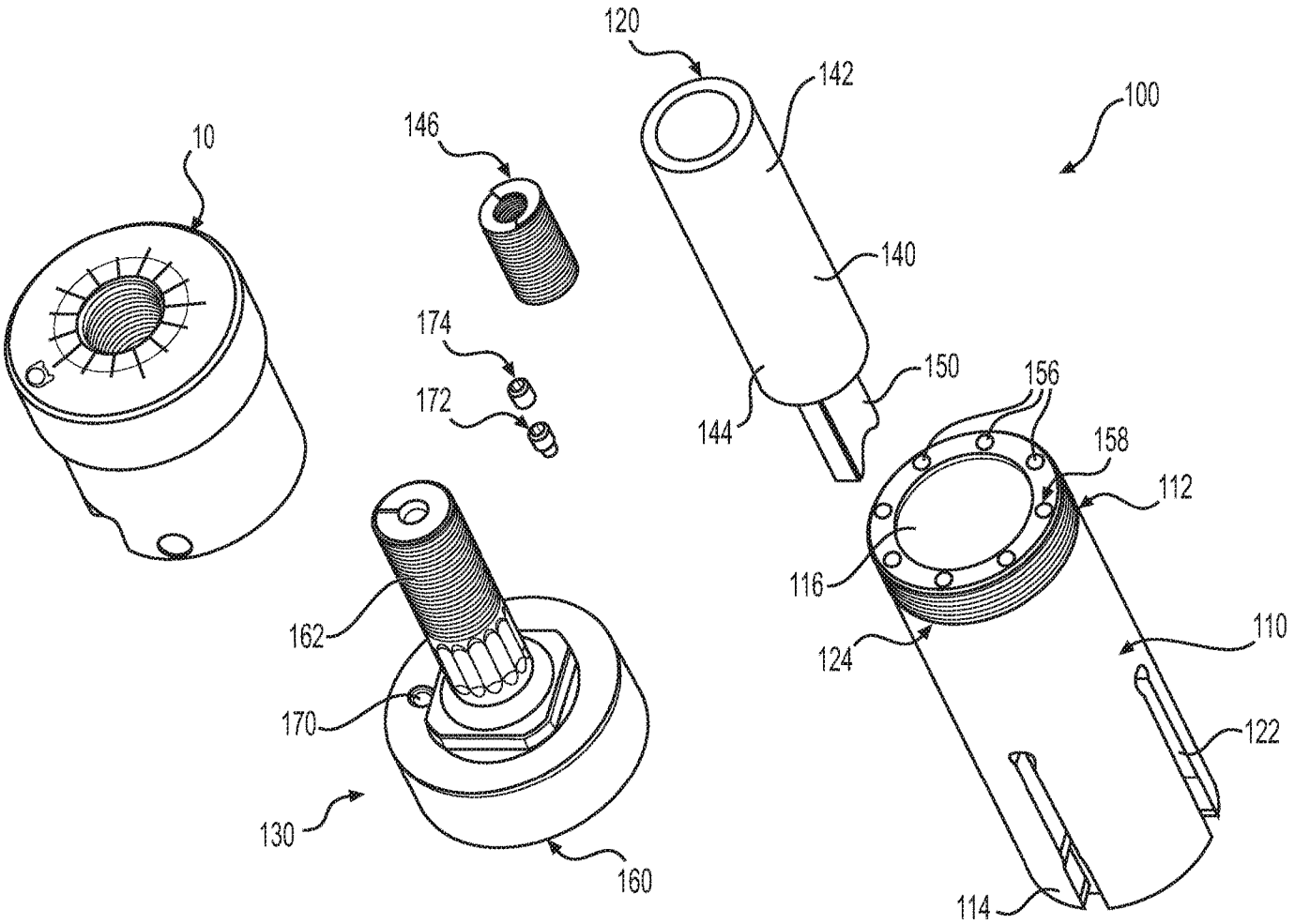
FIG. 1 is an exploded top perspective view of a punch body assembly according to an exemplary embodiment of the present invention.

Referring to FIGS. 1-4, the present invention relates to a punch body assembly 100 for a punching tool. The punch body assembly 100 is designed to allow easy in-field adjustment of the length of the punching tool, particularly as the tool wears down. The punch body assembly 100 according to an exemplary embodiment of the present invention generally includes a punch body 110 that retains an ejector member 120 and engages a driver 130. The adjustment mechanism of the present invention, discussed in detail below, allows for adjusting the axial position of the driver 130 with respect to the punch body 110, that is adjusting the axial distance between the driver 130 and the punch body 110, to lengthen the tool such as when its wears down from use. This allows the end user to re-surface the face of the punch body 110 while keeping the ejector member 120 at its same setting in the punching machine. The driver 130 preferably engages a punch head 10, such as the punch head disclosed in commonly assigned patent application Ser. No. 15/479,028 entitled Adjustable Punch Head Assembly, filed concurrently herewith, the subject matter of which is herein incorporated by reference.

Punch body 110 provides a cutting function for the punching tool. Punch body 110 includes a driver engagement end 112, opposite cutting end 114, and a longitudinal inner bore 116 extending therebetween. Punch body 110 may have a generally cylindrical shape. Inner bore 116 includes an inwardly extending shoulder 118 (FIG. 4) that supports the ejector member 120. One or more elongated slots 122 may be provided in punch body 110 that provide a key for aligning punch body assembly 100 with a punching machine. Each elongated slot 122 preferably extends from about the middle of punch body 110 to the cutting end 114 thereof. A number of the elongated slots 122 may be annularly spaced from one another around the punch body 110.

The driving engagement end 112 of punch body 110 has an adjustable engagement 124 for mating with driver 130. Adjustable engagement 124 may be any type of engagement mechanism that allows adjustability of the axial length between punch body 110 and driver 130. For example, adjustable engagement 124 may be external threads at the punch body's driving engagement end 112, as seen in FIG. 1.

Figure 4:
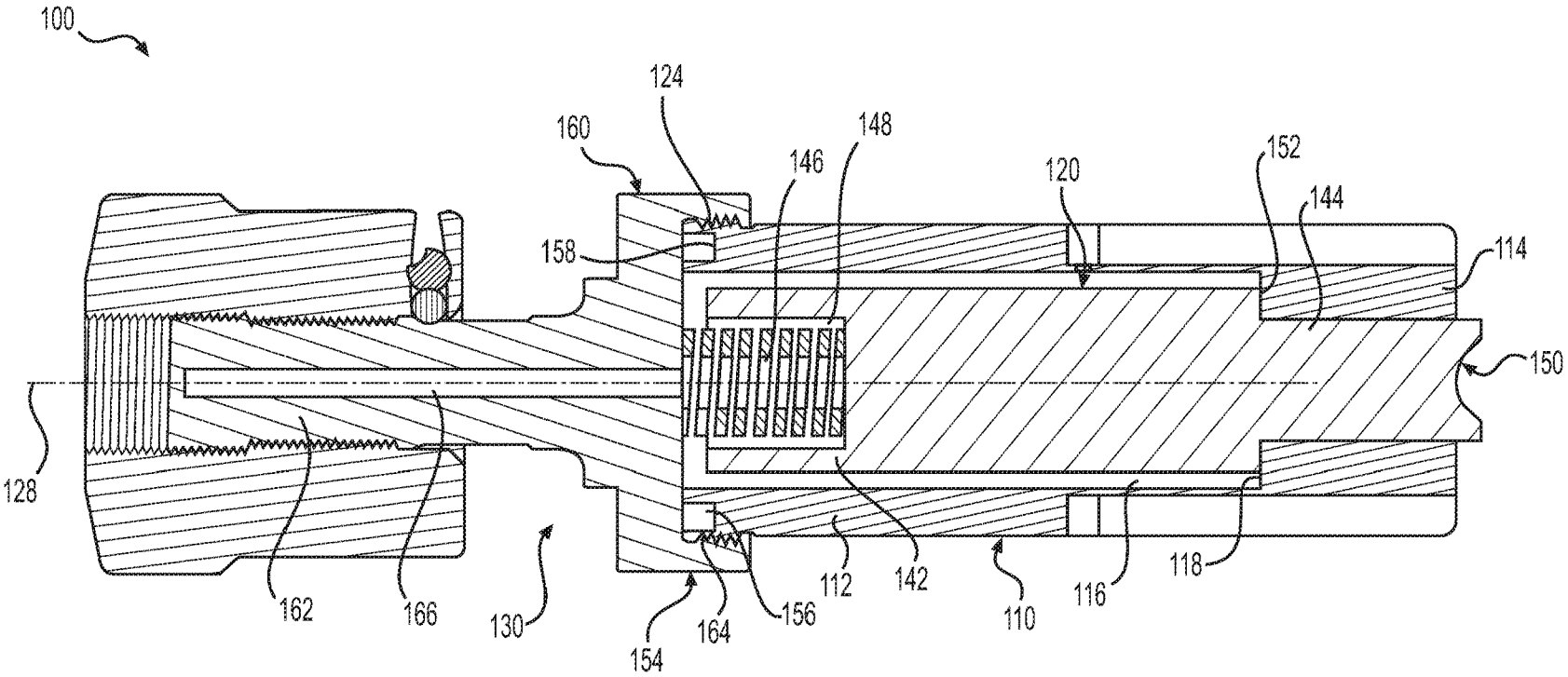
FIG. 4 is a cross-sectional view of the punch body assembly illustrated in FIG. 3.

The ejector member 120 is supported by punch body 110 in its inner bore 116 inside of punch body 110, as best seen in FIG. 4. Ejector member 120 may be an ejector pin that has a body 140 with opposing ends 142 and 144. End 142 of ejector member 120 is preferably spring biased by a spring 146 disposed in the punch body's inner bore 116 between end 142 and driver 130, as seen in FIG. 4. The ejector member's end 142 may have a cavity 148 that accommodates at least of portion of spring 146. The other end 144 of ejector member 120 has an ejector extension 150 that extends through the cutting end 114 of punch body 110 for ejecting a punched part. Ejector extension 150 preferably has a smaller diameter that the rest of the ejector member's body 140, thereby defining an outer shoulder 152 which can abut the inwardly extending shoulder 118 when ejector member 120 is installed in punch body 110.

Figure 3:
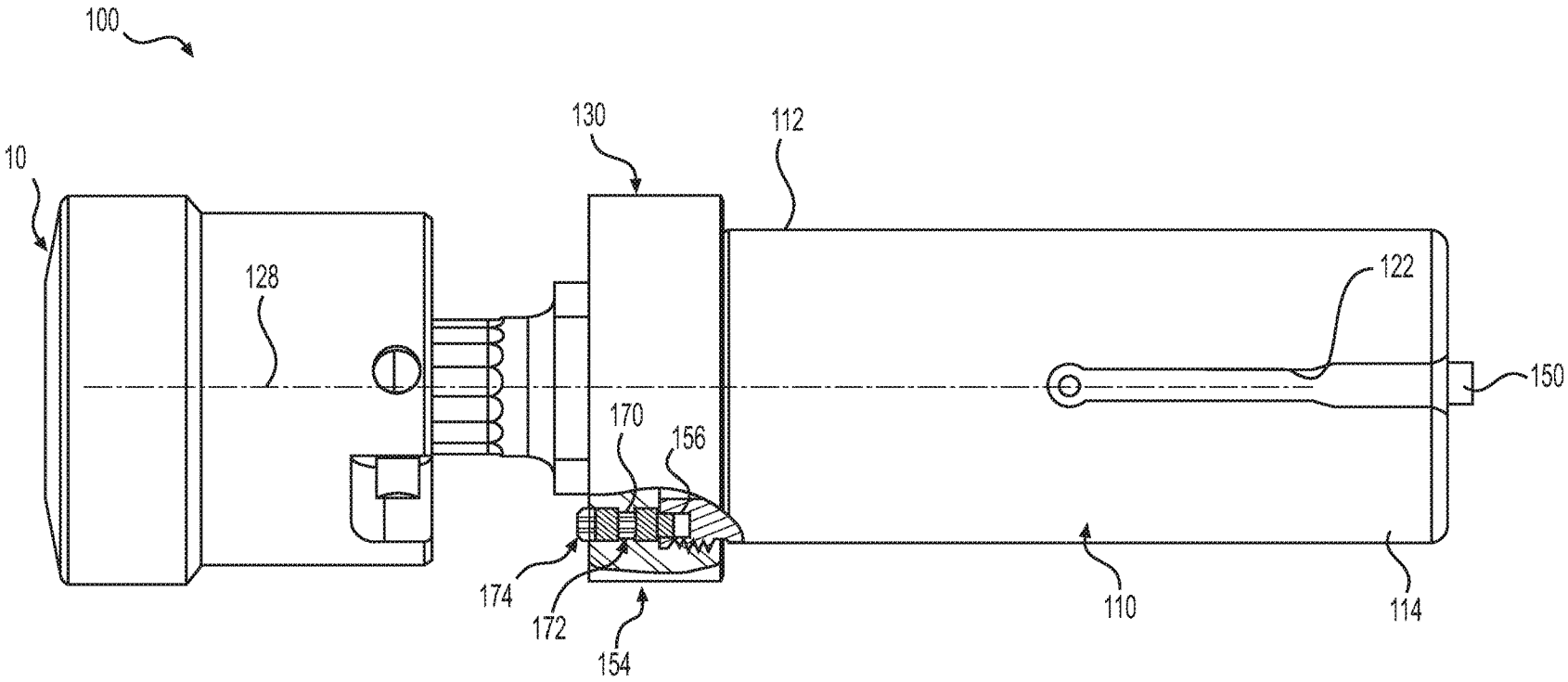
FIG. 3 is a side elevational view of the punch body assembly illustrated in FIG. 1, showing a portion thereof cut away.

A locking mechanism 154 (FIGS. 3 and 4) may be provided at the driving engagement end 112 of punch body 110 for locking driver 130 to punch body 110, and preferably to lock in the axial position of driver 130 with respect punch body 110 along its longitudinal axis 128 (FIG. 3). Locking mechanism 154 may include one or more position bores 156 disposed in the end face 158 of the punch body's driver engagement end 112. In a preferred embodiment, a plurality of position bores 156 are annularly arranged on end face 158 around the opening to the punch body's inner bore, as best seen in FIG. 1.

Figure 2:
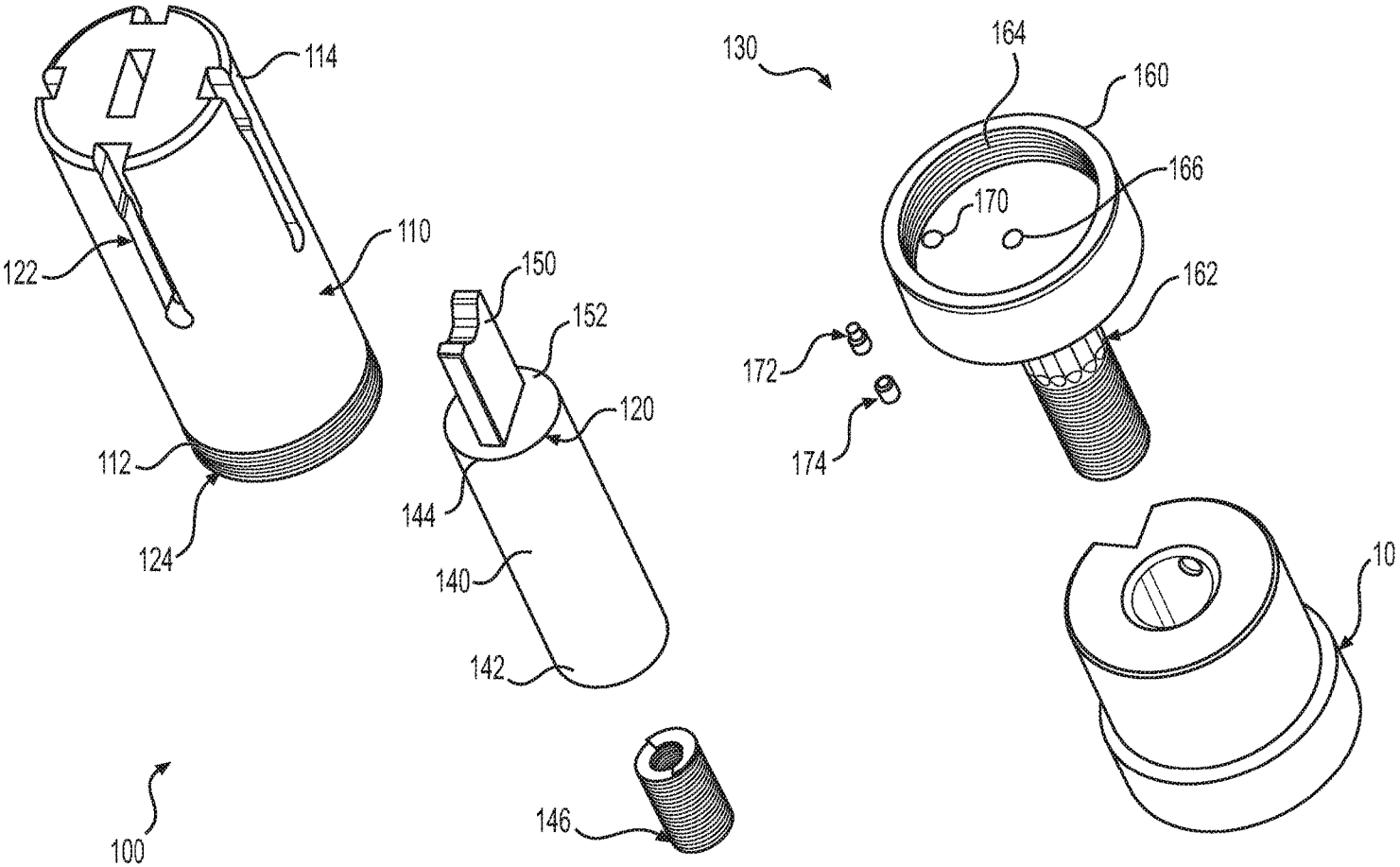
FIG. 2 is an exploded bottom perspective view of a punch body assembly illustrated in FIG. 1.

Driver 130 is configured to rotatably and adjustably couple to the driver engagement end 112 of punch body 110. Driver 130 generally includes a base 160 that engages punch body 110 and a stem 162 extending therefrom that engages the punch head 10. A central bore 166 may be provided that extends through stem 162 and base 160. Central bore 166 allows air or oil mist to pass through the tool to the outer diameter of punch body 110 for keeping the tool lubricated in the punching machine. Base 160 preferably includes an adjustable engagement 164 that cooperates with adjustable engagement 124 of punch body 110 to adjust the axial position of driver 130 with respect to punch body 110 on longitudinal axis 128 when needed. Adjustable engagement 164 may be internal threads adapted to engage the external threads of adjustable engagement 124 of punch body 110. In a preferred embodiment, the internal threads of adjustable engagement 164 are located in the bottom of the base 160, as best seen in FIGS. 2 and 4. The end face 158 of punch body 110 is received in the bottom of base 160 allowing engagement of the internal and external threads. Although a threaded engagement between driver 130 and punch body 110 is preferred, adjustable engagements 124 and 164 may be any engagement mechanism that allows adjustment of the axial position of driver 130 with respect to punch body 110.

By rotating driver 130 with respect to punch body 110, the distance between the driver's base 160 and the driver engagement end 112 of punch body 110 can be increased or decreased via threads of the adjustable engagements 124 and 164, thereby establishing an axial position of driver 130 on longitudinal axis 128. Once the desired axial position of driver 130 is selected, that selected axial position of driver 130 can be locked in via locking mechanism 154. In a preferred embodiment, locking mechanism 154 includes at least one locking hole 170 that extends through the base 160 of driver 130. Locking hole 170 is configured to align with one of the position bores 156 of punch body 110. The driver 130 may be rotated with respect the punch body 110 until the locking hole 170 aligns with one of the position bores 156. A fastener 172 may be inserted in the aligned locking hole 170 and the one of the position bores 156 to locking the axial position of the driver 130 with respect to punch body 110. Fastener 172 may be a set screw, for example. For safety, a second fastener 174, such as another set screw, may be provided that cooperates with the first fastener 172. Use of more than one fastener reduces the chance of the fasteners becoming loose from driver 130 and punch body 110.

The method of adjusting the punch body assembly 100 according to the present invention comprises the steps of coupling base 160 of driver 130 to driver engagement end 112 of the punch body 110; rotating driver 130 with respect to the punch body 110 until a select axial position of driver 130 with respect to the punch body 110 is reached along the longitudinal axis 128 of the punch body 110; and locking the select axial position of driver 130. The step of coupling driver 130 to the punch body includes threadably coupling the base 160 of driver 130 to driver engagement end 112 of the punch body 110.

The method may further includes the steps of rotating driver 130 with respect to the punch body 110 to the select axial position any aligning one of the plurality of positions bores 156 in driver engagement end 112 of the punch body 110 with locking hole 170 in the base 160 of driver 130 and locking the select axial position of driver 130 by inserting at least one fastener 172 through locking hole 172 and through the one of plurality of positions bores 156 aligned with locking hole 170.

To change or adjust the driver's axial position, the method of the present invention may also include the steps of unlocking the select axial position of the driver 130 by removing fastener 172; rotating driver 130 with respect to the punch body 100 until another axial position of the driver with respect to the punch body is reached along the longitudinal axis 128; and then locking the driver 130 in the second select axial position be re-inserting the fastener 172.

While a particular embodiment has been chosen to illustrate the invention, it will be understood by those skilled in the art that various changes and modifications can be made therein without departing from the scope of the invention as defined in the appended claims.

What is claimed is:

1. An adjustable punch body assembly, comprising:

a punch body including a driver engagement end and an opposite cutting end, and a longitudinal inner bore extending between said driver engagement and cutting ends, said driver engagement end including a first adjustable engagement, and said punch body defining a longitudinal axis;

a driver configured to adjustably couple to said punch body, said driver including a base having a second adjustable engagement corresponding to said first adjustable engagement of said punch body to establish an axial position of the driver with respect to said punch body on said longitudinal axis, and a stem extending from said base for mating with a punch head; and a locking mechanism at said driver engagement end of said punch body for locking said axial position of said driver.

2. An adjustable punch body assembly according to claim 1, wherein said driver is rotatably coupled to said driver engagement end of said punch body.

3. An adjustable punch body assembly according to claim 2, wherein said first adjustable engagement comprises external threads on said driver engagement end of said punch body; and said second adjustable engagement comprises internal threads in said base of said driver that engage said external threads.

4. An adjustable punch body assembly according to claim 1, further comprising an ejector member retained by said punch body, said ejector member having a body that is spring biased at one end and has an ejector extension at the other end.

5. An adjustable punch body assembly according to claim 4, wherein a spring is disposed between said one end of said ejector member and said base of said driver.

6. An adjustable punch body assembly according to claim 1, wherein said locking mechanism includes a plurality of position bores disposed in said driver engagement end of said punch body.

7. An adjustable punch body assembly according to claim 6, wherein said plurality of position bores are arranged annularly around an end face of said driver engagement end of said punch body.

8. An adjustable punch body assembly according to claim 6, wherein said base of said driver includes at least one locking hole that axially aligns with one of said plurality of position holes.

9. An adjustable punch body assembly according to claim 6, wherein at least one fastener is received in said locking hole of said base and in said one of said plurality of position holes of said punch body for locking said driver in said axial position.

10. An adjustable punch body assembly according to claim 1, wherein said cutting end of said punch body includes at least one external slot for aligning the punch body with a punching machine.

11. An adjustable punch body assembly, comprising:

a punch body including a driver engagement end and an opposite cutting end, and a longitudinal inner bore extending between said driver engagement and cutting ends, and said punch body defining a longitudinal axis;

a driver configured to adjustably couple to said punch body, said driver including a base and a stem extending from said base for mating with a punch head;

means for adjusting an axial position of said driver with respect to said punch body on said longitudinal axis; and means for locking said axial position of said driver.

12. An adjustable punch body assembly according to claim 11, wherein said means for adjusting includes mating external and internal threads of said punch body and said driver, respectively.

13. An adjustable punch body assembly according to claim 11, wherein said means for locking includes a plurality of position bores disposed in said punch body;

said base including a locking hole that aligns with one of said plurality of position bores; and a fastener extends through said locking hole and said one of said plurality of position bores.

14. An adjustable punch body assembly according to claim 11, further comprising an ejector member retained by said punch body, said ejector member having a body that is spring biased at one end and has an ejector extension at the other end.

* * * * *